US006241136B1

(12) United States Patent
Harriss

(10) Patent No.: US 6,241,136 B1
(45) Date of Patent: Jun. 5, 2001

(54) APPARATUS AND METHOD FOR CARRYING A CHILD

(76) Inventor: Paul R. Harriss, 861 Arbor Ct., Livermore, CA (US) 94550

( * ) Notice: Subject to any disclaimer, the term of this patent is extended or adjusted under 35 U.S.C. 154(b) by 0 days.

(21) Appl. No.: 09/491,849

(22) Filed: Jan. 26, 2000

(51) Int. Cl.[7] ..... A61G 1/00
(52) U.S. Cl. ..... 224/158; 224/660; 128/882
(58) Field of Search ..... 224/158, 159, 224/660, 662, 682, 671, 674, 250; 54/44.2; 128/882; 602/27, 28, 29

(56) References Cited

U.S. PATENT DOCUMENTS 874,945 * 12/1907 Davey ..... 224/148.6
4,608,811 9/1986 Echeverri .
4,709,693 * 12/1987 Key ..... 224/250
4,762,257 * 8/1988 Spiller et al. ..... 224/250 X
4,766,891 8/1988 Schultz .
4,848,067 * 7/1989 Martinsen ..... 54/44
4,901,898 2/1990 Colombo et al. .
5,435,272 7/1995 Epstein .
5,437,402 8/1995 Ring .
5,718,363 * 2/1998 Graves ..... 224/250
5,730,339 * 3/1998 Stolfo ..... 224/250 X
5,934,281 * 8/1999 Brocher ..... 128/869

* cited by examiner

*Primary Examiner*—Gregory M. Vidovich
(74) *Attorney, Agent, or Firm*—Thomas R. Lampe

(57) ABSTRACT

A support is positioned about an individual's waist in engagement with the individual's hips. A pair of stirrups depend from the support and accommodate the feet of a standing child being carried by the individual.

6 Claims, 2 Drawing Sheets

APPARATUS AND METHOD FOR CARRYING A CHILD

TECHNICAL FIELD

This invention relates to an apparatus and a method facilitating carrying of a child by an individual. More particularly, the invention allows a child to be carried while the child is standing.

BACKGROUND OF THE INVENTION

A number of devices have been devised for carrying infants and young children. Such devices often are not appropriate or useful for carrying larger children. Nor are known conventional arrangements adapted to support a standing child.

The following patents are known and are believed to be generally representative of the state of the art in this field: U.S. Pat. No. 4,901,898, issued Feb. 20, 1990, U.S. Pat. No. 5,435,272, issued Jul. 25, 1995, U.S. Pat. No. 4,608,811, issued Sep. 2, 1986, U.S. Pat. No. 5,437,402, issued Aug. 1, 1995, and U.S. Pat. No. 4,766,891.

DISCLOSURE OF INVENTION

According to the approach of the invention disclosed and claimed herein, a relatively simple and inexpensive apparatus is disclosed for efficiently and reliably carrying a child, the approach having particular application for use by an individual when carrying a larger child. The weight of the carried child is carried primarily by the hips of the individual doing the carrying and the child when standing is positioned to encircle his or her arms about the individual in the vicinity of the individual's neck to safely maintain the child in position when carried.

The apparatus includes a support for positioning about an individual's waist and for engaging the individual's hips when positioned about the individual's waist.

Releasably securement means is connected to the support for releasably securing the support in position about the individual's waist.

A pair of foot engagement members is provided, each foot engagement member of the pair of foot engagement members for engagement by a foot of a standing child to support the standing child.

Connectors extend between the support and the foot engagement members to retain the foot engagement members at spaced locations on opposed sides of the individual and disposed at an elevation below the support. This allows the standing child to stand on the foot engagement members with the standing child's body positioned behind the individual's back and the standing child's arms proximate the individual's neck whereby the standing child's arms are positioned to encircle the individual in the vicinity of the individual's neck to maintain the standing child in a desired position relative to the individual while carried by the individual.

The invention also is directed to a method for supporting and carrying a standing child. The method includes the step of positioning a support about an individual's waist.

Two foot engagement members depending from the support are positioned on opposed sides of the individual and disposed at an elevation below the support.

The child's feet are positioned on the foot engagement members to provide support for the child.

The method also includes standing the child on said foot engagement members with the child's body positioned behind the individual's back and the standing child's arms proximate the individual's neck whereby the standing child's arms are positioned to encircle the individual in the vicinity of the individual's neck to maintain the child standing in a desired position relative to the individual while carried by the individual.

Other features, advantages, and objects of the present invention will become apparent with reference to the following description and accompanying drawings.

BEST MODE FOR CARRYING OUT THE INVENTION

Figure 1:
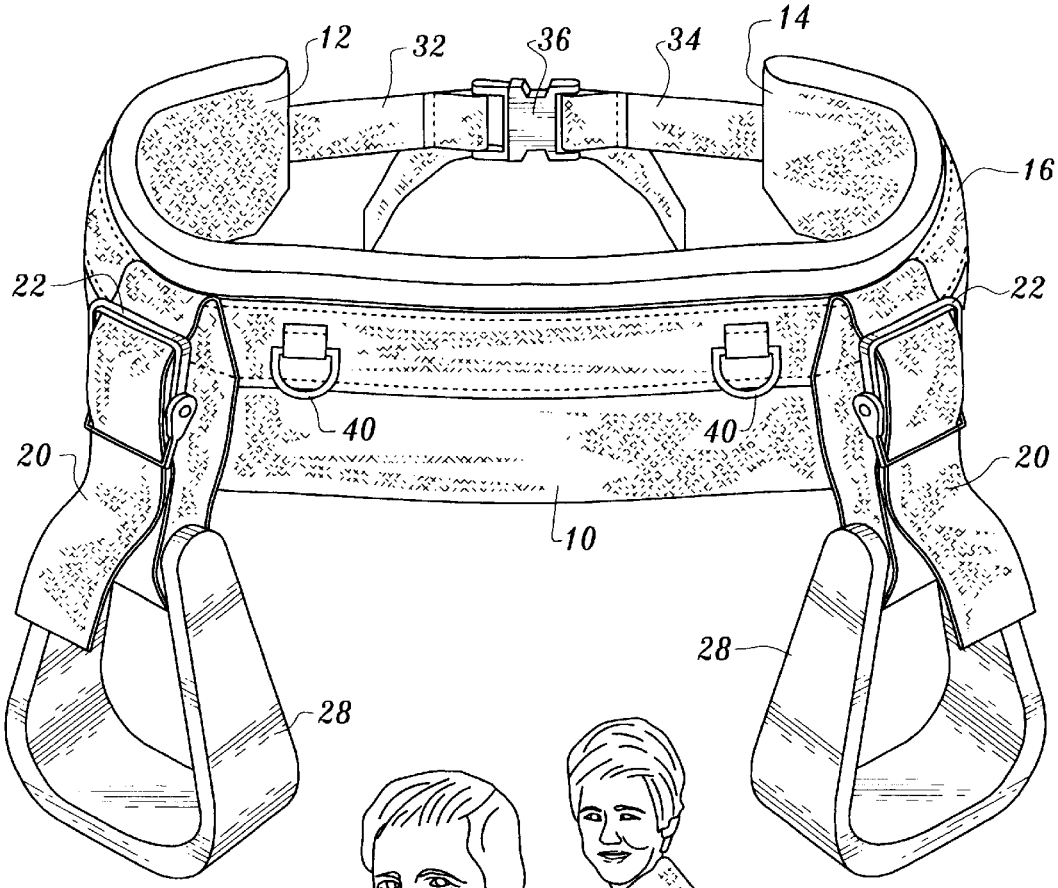
FIG. 1 is a rear perspective view of apparatus constructed in accordance with the teachings of the present invention.
Figure 2:
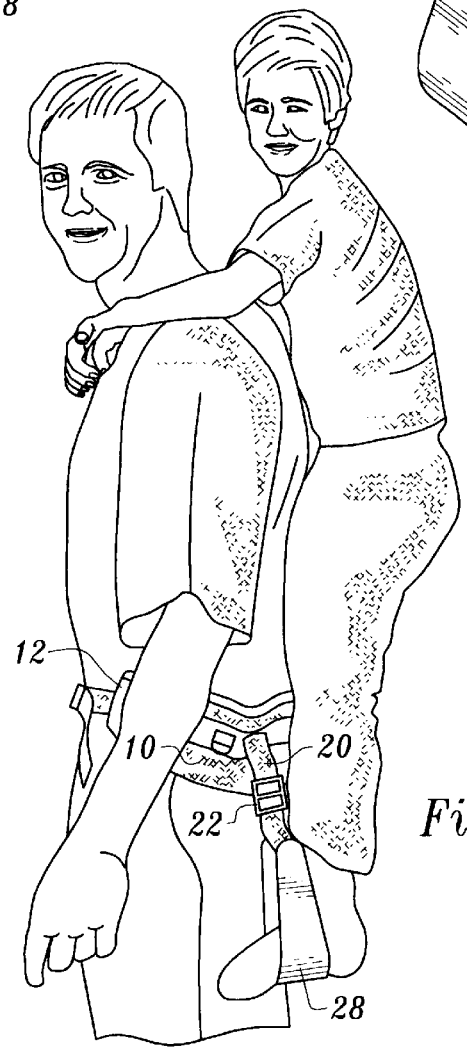
FIG. 2 is a perspective view illustrating an individual wearing the apparatus and carrying a standing child.

Referring to the drawings, apparatus constructed in accordance with the teachings of the present invention includes a support 10 having free ends 12, 14. The support is for positioning about an individual's waist and for engaging the individual's hips when positioned about the waist. FIG. 2 illustrates the support so positioned and the apparatus being employed by an individual to carry a standing child.

Support 10 may be formed of any suitable material. For example, the support may comprise a band-like sleeve of cloth or other suitable material having a plastic or rubber foam material disposed therein. If desired, one or more stiffener elements formed of plastic or the like may be disposed within the sleeve. The support 10 includes an outer strip of material 16 stitched or otherwise secured to the rest of the support. The strip 16 may suitably be formed of nylon although any other suitable material may be utilized.

Attached to support 10 are flexible straps 20 of nylon webbing or any other suitable material. In the arrangement illustrated the flexible straps 20 are sewn in place on support 10 in the vicinity of strip 16. Buckles 22 of any suitable type may be utilized to vary the effective lengths of the flexible straps. The straps 20 are attached to the support at locations between the buttocks of the individual wearing the support and the outermost hip areas of the individual. That is, the flexible straps in the arrangement illustrated are not fastened at the outermost side extremities of the support 10 but rather are offset somewhat toward the rear of the support.

Connected to and depending from straps 20 are foot engagement members in the form of stirrups 28. Adjustment of the effective lengths of the flexible straps 20 by means of buckles 22 will vary the distances between the stirrups 28 and the support 10.

A flexible belt comprised of two belt sections 32, 34 is connected to the support. In particular, each belt section is attached to a free end of the support, as by stitching or the like. A latch 36 is employed to releasably secure the belt sections 30, 32 together, it being appreciated that the belt sections may be adjusted relative to the components of latch 36 to vary the overall length of the belt.

FIG. 2 shows the apparatus in position on an individual, the support positioned about the individual's waist and engaging the individual's hips. The stirrups 28 depend from the support at spaced locations on opposed sides of the individual and are disposed at an elevation below the support. The distance of the stirrups from the support can be varied as indicated above by changing the effective lengths of flexible straps 20.

The child to be carried positions his or her feet on the stirrups. The stirrups provide support for the child, carrying virtually all of the child's weight and transferring same to the wearer's hips, thus virtually eliminating the possibility of back strain which can be a particular problem when carrying a larger child. The child stands on the stirrups, as shown in FIG. 2, with his or her body positioned behind the wearer's back. The standing child's arms are proximate to the neck of the carrying individual whereby they are positioned to encircle the carrier's body in the vicinity of his or her neck. This is primarily for the purpose of maintaining the child standing in a desired position relative to the individual while carried by the individual since very little weight need be assumed and carried by the wearer's shoulders or neck.

Figure 3:
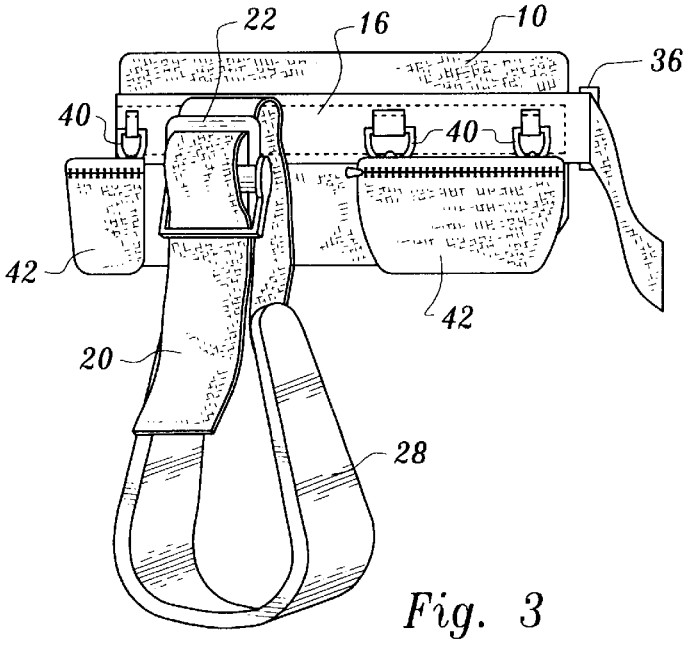
FIG. 3 is an elevational side view of the apparatus and illustrating the apparatus employed to carry objects in the form of pouches.
Figure 4:
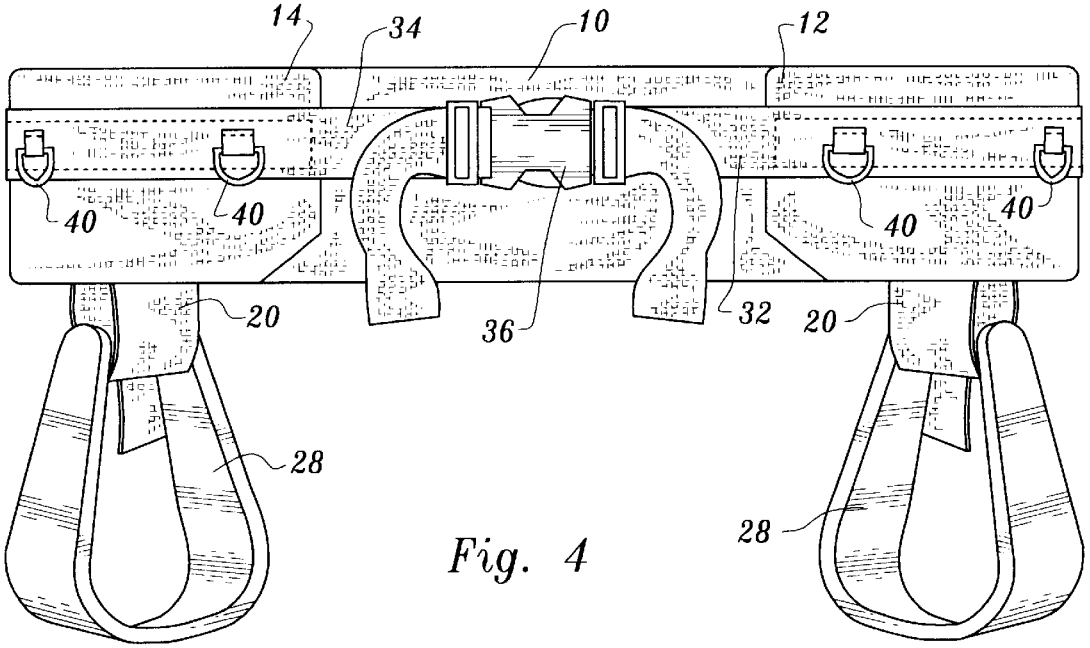
FIG. 4 is a frontal elevational view of the apparatus.

The apparatus illustrated includes connectors in the form of D-rings 40 located at strip 16 which may be utilized to carry objects. FIG. 3, for example, illustrates pouches 42 being releasably secured to support 10 at the D-rings.

What is claimed is:

1. Apparatus for allowing a standing individual to carry a standing child, said apparatus comprising in combination:

an elongated support adapted to be positioned on the standing individual's waist and wrapped thereabout engaging the standing individual's hips to prevent downward movement of the elongated support on the individual's body, said elongated support oriented substantially horizontally on the individual's body;

releasable securement means connected to said elongated support for releasably securing said elongated support in position on the standing individual's waist;

a pair of stirrups, each stirrup of said pair of stirrups for engagement by a foot of a standing child to support the standing child; and a pair of flexible straps respectively extending downwardly in a substantially vertical direction from said elongated support between said elongated support and said stirrups retaining said stirrups at spaced locations on opposed sides of the standing individual and disposed at an elevation below said elongated support allowing the standing child to stand on said stirrups with the standing child's body positioned behind the standing individual's back and the standing child's arms proximate the standing individual's neck whereby the standing child's arms are positioned to encircle the standing individual in the vicinity of the standing individual's neck to maintain the standing child in a desired standing position relative to the standing individual while carried by the standing individual.

2. The apparatus according to claim 1 wherein each of said flexible straps includes adjustment means for adjusting the distances between said stirrups and said elongated support.

3. The apparatus according to claim 2 wherein said adjustment means comprises buckles connected to said flexible straps for selectively varying the effective lengths of said flexible straps and the distances between said stirrups and said elongated support.

4. The apparatus according to claim 1 additionally comprising at least one retention member attached to said elongated support to releasably connect an object to said elongated support and retain said object on said elongated support.

5. The apparatus according to claim 1 wherein said elongated support has two free ends spaced from one another, said releasable securement means including at least one flexible belt extending between said free ends.

6. The apparatus according to claim 5 wherein said releasable securement means additionally comprises a latch connected to said at least one flexible belt.

* * * * *